US007382084B2

(12) United States Patent
Yoshimoto et al.

(10) Patent No.: US 7,382,084 B2
(45) Date of Patent: Jun. 3, 2008

(54) SPARK PLUG HAVING A PRECIOUS METAL TIP

(75) Inventors: Osamu Yoshimoto, Nagoya (JP); Wataru Matsutani, Nagoya (JP); Yoshihiro Matsubara, Nagoya (JP); Kenji Nunome, Nagoya (JP)

(73) Assignee: NGK Spark Pulg Co., Ltd., Nagoya (JP)

( * ) Notice: Subject to any disclaimer, the term of this patent is extended or adjusted under 35 U.S.C. 154(b) by 228 days.

(21) Appl. No.: 10/514,786

(22) PCT Filed: Mar. 22, 2004

(86) PCT No.: PCT/JP2004/003831

§ 371 (c)(1),
(2), (4) Date: Nov. 19, 2004

(87) PCT Pub. No.: WO2004/105204

PCT Pub. Date: Dec. 2, 2004

(65) Prior Publication Data

US 2006/0061250 A1 Mar. 23, 2006

(30) Foreign Application Priority Data

Mar. 25, 2003 (JP) ..... 2003-082491
May 28, 2003 (JP) ..... 2003-151102

(51) Int. Cl.
*H01T 13/20* (2006.01)

(52) U.S. Cl. ..... 313/141; 313/118; 313/143; 313/144; 123/169 EL

(58) Field of Classification Search ..... 313/141
See application file for complete search history.

(56) References Cited

U.S. PATENT DOCUMENTS

| | | | | |
|---|---|---|---|---|
| 4,743,793 | A * | 5/1988 | Toya et al. | 313/141 |
| 5,998,913 | A * | 12/1999 | Matsutani | 313/141 |
| 6,094,000 | A | 7/2000 | Osamura et al. | |
| 2003/0038576 | A1 | 2/2003 | Matsutani et al. | |
| 2003/0038577 | A1 | 2/2003 | Hori et al. | |
| 2003/0085644 | A1 * | 5/2003 | Sugiyama et al. | 313/141 |
| 2003/0122461 | A1 | 7/2003 | Menken et al. | |
| 2003/0155849 | A1 * | 8/2003 | Hori | 313/141 |
| 2004/0027042 | A1 | 2/2004 | Matsutani et al. | |

FOREIGN PATENT DOCUMENTS

| | | |
|---|---|---|
| JP | A-2002-359051 | 12/2002 |
| JP | A-2003-68421 | 3/2003 |

* cited by examiner

*Primary Examiner*—Sikha Roy
(74) *Attorney, Agent, or Firm*—Morgan, Lewis & Bockius LLP

(57) ABSTRACT

An object of the invention is to provide a spark plug having a discharge portion made of a precious metal tip, in which peeling of the precious metal tip from a surface of the discharge portion can be suppressed while spark abrasion, oxidation abrasion and abnormal abrasion of the discharge portion can be suppressed.

14 Claims, 3 Drawing Sheets

SPARK PLUG HAVING A PRECIOUS METAL TIP

TECHNICAL FIELD

The present invention relates to a spark plug used in an internal combustion engine.

BACKGROUND

A spark plug used for ignition in an internal combustion engine such as an automobile engine has a tendency toward increase in temperature inside a combustion chamber for the purposes of increase in engine output and improvement in fuel efficiency. An engine of the type having a combustion chamber into which a discharge portion of a spark plug is protruded while located opposite to a spark discharge gap of the spark plug has been used widely in order to enhance ignitability. Under such circumstances, the discharge portion of the spark plug is apt to be worn out acceleratedly by spark discharge because it is exposed to a high temperature. In order to improve spark resistance of the discharge portion opposite to the spark discharge gap, a large number of proposals have been made for a spark plug of the type in which a precious metal tip mainly containing Ir or the like is welded to a leading end of an electrode.

For example, in Patent Document 1, a precious metal tip containing Ir as a main component, Rh and Ni has been described. This is for the following reasons. Good durability against abrasion caused by spark discharge (hereinafter also referred to as spark abrasion) can be used wisely since Ir has a high melting point (2410° C.). In addition, resistance to abrasion caused by volatilization of Ir oxidized at a high temperature (of not lower than 900° C.) (hereinafter also referred to oxidation abrasion) can be improved since Rh is added to Ir in order to prevent the oxidation abrasion of Ir. In the spark plug having such a discharge portion made of a precious metal tip containing Ir as a main component, and Rh, however, abnormal abrasion still occurred in accordance with the condition of use so that an outer circumferential side surface of the discharge portion which was not a discharge surface located in a position opposite to the spark discharge gap was gouged out circularly after operation. In Patent Document 1, therefore, attention has been paid to Ni as a component for suppressing the abnormal abrasion. That is, since Ni was further added to the precious metal tip containing Ir as a main component, and Rh, the abnormal abrasion could be suppressed while both spark abrasion and Ir oxidation abrasion could be prevented.

[Patent Document 1]

Japanese Patent Laid-Open No. 2002-359050

DISCLOSURE OF THE INVENTION

Even when the precious metal tip containing Ir as a main component, Rh and Ni as described in Patent Document 1 was used in the discharge portion, there might however occur a phenomenon that the discharge portion sweated to generate granular sagging in a surface of the discharge portion, and that the surface of the discharge portion finally peeled off like a film. The present inventors operated a spark plug in which a discharge portion made of a precious metal tip containing Ir as a main component, 1 mass % of Rh, and 1 mass % of Ni was provided only in a center electrode, in the condition that a 1-minute's operation in a full throttle state at 9600 rpm and a 30-seconds' operation in an idling state were repeated alternately. After 100 hours, the inventors observed the external appearance of the discharge portion. As a result, peeling of precious metal from the surface of the discharge portion was found as shown in FIG. 3. If the peeling occurred, the volume of the discharge portion decreased to thereby spoil durability. Incidentally, the peeling could not be eliminated perfectly by the background-art method provided to suppress the spark abrasion, oxidation abrasion and abnormal abrasion of the discharge portion.

An object of the invention is to provide a spark plug having a discharge portion made of a precious metal tip, in which sweating and peeling of precious metal in a surface of the discharge portion can be suppressed while spark abrasion, oxidation abrasion and abnormal abrasion of the discharge portion can be suppressed.

In order to achieve the object, according to claim 1, there is provided a spark plug comprising a center electrode, and a ground electrode disposed so that its side surface is opposite to a leading end portion of the center electrode, characterized in that: a precious metal tip is welded to at least one of the center electrode and the ground electrode to thereby form a discharge portion having a discharge surface in a position opposite to a spark discharge gap; and the precious metal tip contains Ir as a main component, Rh, and Ni and further contains at least one of Pt and Pd.

According to a result of the present inventors' examination, there is obtained a finding that the sweating and peeling of the discharge portion can be suppressed when the discharge portion is made of a precious metal tip containing Ir as a main component, Rh, and Ni and further containing at least one of Pt and Pd. Accordingly, when the discharge portion is made of precious metal tip containing Ir as a main component, Rh and Ni and further containing at least one of Pt and Pd, the sweating and peeling of precious metal in a surface of the discharge portion can be suppressed while the sparking abrasion, oxidation abrasion and abnormal abrasion up to now can be suppressed. Incidentally, in the invention, the phrase "Ir as a main component" means that 50 wt % or more of Ir is contained in the precious metal tip.

Preferably, the amount of at least one of Pt and Pd contained in the precious metal tip is not smaller than the amount of Ni contained in the precious metal tip. If the total amount of Pt and Pd contained in the precious metal tip is smaller than the amount of Ni contained in the precious metal tip, there is fear that the effect on suppressing the peeling cannot be obtained sufficiently. Accordingly, when the amount of at least one of Pt and Pd contained in the precious metal tip is not smaller than the amount of Ni contained in the precious metal tip, the sweating and peeling of precious metal in the surface of the discharge portion can be suppressed effectively.

Preferably, the amount of at least one of Pt and Pd contained in the precious metal tip is in a range of from 1 mass % to 20 mass %. If the total amount of Pt and Pd contained in the precious metal tip is smaller than 1%, there is fear that the effect on suppressing the peeling cannot be obtained sufficiently. On the other hand, if the total amount of Pt and Pd contained in the precious metal tip is larger than 20 mass %, the melting point of the precious metal tip is lowered so that resistance to spark abrasion of the discharge portion is lowered, quite undesirably. Accordingly, when at least one of Pt and Pd in the aforementioned range is further contained in the aforementioned range, it is possible to effectively suppress the peeling of precious metal in the surface of the discharge portion containing Ir as a main component, Rh, and Ni. In order to prevent the sweating not reaching the peeling, it is further preferable that the amount of at least one of Pt and Pd contained in the precious metal tip is in a range of from 4 mass % to 8 mass %. Incidentally, the precious metal tip is made of an Ir-based alloy containing Ir as a main component. The Ir-based alloy can be used suitably in the discharge portion because it is good in durability against spark discharge.

Preferably, the amount of Ni contained in the precious metal tip is in a range of from 0.5 mass % to 8 mass %. If the Ni content is smaller than 0.5 mass %, there is a possibility that the effect on suppressing abnormal abrasion cannot be obtained sufficiently. On the other hand, if the Ni content is larger than 8 mass %, it is quite undesirable that resistance to spark abrasion of the discharge portion is lowered because of the excessively large Ni content, and that resistance to oxidation abrasion of the discharge portion is lowered because of increase in Ni oxide. Accordingly, when the Ni content is in the aforementioned range, it is possible to effectively suppress abnormal abrasion of the discharge portion containing Ir as a main component, and Rh.

Preferably, the amount of Rh contained in the precious metal tip is in a range of from 0.5 mass % to 40 mass %. If the Rh content is smaller than 0.5 mass %, there is a possibility that the effect on suppressing oxidation abrasion of the discharge portion cannot be obtained sufficiently. On the other hand, if the Rh content is larger than 40 mass %, there is a possibility that the effect on suppressing spark abrasion of the discharge portion cannot be obtained effectively because the melting point of the precious metal tip is lowered by the large Rh content. Accordingly, when the Rh content is in the aforementioned range, it is possible to effectively suppress oxidation abrasion of the discharge portion containing Ir.

The precious metal tip may further contain an oxide (inclusive of a composite oxide) of an element selected from Sr, Y, La, Ce, Pr, Nd, Sm, Eu, Gd, Tb, Dy, Ho, Er, Tm, Yb, Lu, Ti, Zr and Hf. Thus, oxidation abrasion of Ir at a high temperature can be suppressed more effectively. The oxide content may be set suitably to be in a range of from 0.5 mass % to 3 mass %. If the oxide content is smaller than 0.5 mass %, there is a possibility that the oxide's effect on preventing oxidation abrasion of added metal element components cannot be obtained sufficiently. On the other hand, if the oxide content is larger than 3 mass %, there is a possibility that heat resistance of the discharge portion will be spoiled contrariwise. Incidentally, it is preferable that the oxide contains at least one of $Y_2O_3$ and $Zr_2O_3$.

On the other hand, in order to achieve the object, according to claim 9, there is provided a spark plug comprising a center electrode, a center electrode-side discharge portion made of a center electrode-side precious metal tip welded to a leading end portion of the center electrode, a ground electrode disposed opposite to the leading end portion of the center electrode, and a ground electrode-side discharge portion made of a ground electrode-side precious metal tip welded to the ground electrode, characterized in that: a spark discharge gap is formed between the center electrode-side discharge portion and the ground electrode-side discharge portion; the center electrode-side precious metal tip contains Ir as a main component, Rh, and Ni and further contains at least one of Pt and Pd; and the ground electrode-side precious metal tip contains Ir as a main component, and Rh so that the Rh content of the ground electrode-side precious metal tip is larger than the Rh content of the center electrode-side precious metal tip.

In the invention, the precious metal tips (the center electrode-side precious metal tip and the ground electrode-side precious metal tip) used in the center electrode-side discharge portion and the ground electrode-side discharge portion contain Ir as a main component, and Rh. Because each of the center electrode-side precious metal tip and the ground electrode-side precious metal tip contains Ir as a main component in this manner, it is possible to improve resistance to spark abrasion of the center electrode-side discharge portion and the ground electrode-side discharge portion. Moreover, because each of the center electrode-side precious metal tip and the ground electrode-side precious metal tip contains Rh, it is possible to improve resistance to oxidation abrasion of Ir.

The center electrode-side precious metal tip contains Ni, and at least one of Pt and Pd. When the center electrode-side precious metal tip used in the center electrode-side discharge portion contains Ni in this manner, it is possible to suppress abnormal abrasion of the center electrode-side precious metal discharge portion containing Ir, and Rh. Moreover, when the center electrode-side precious metal tip used in the center electrode-side discharge portion further contains at least one of Pt and Pd, it is possible to suppress peeling of precious metal in the surface of the discharge portion of the center electrode-side precious metal discharge portion containing Ir, Rh, and Ni.

In a general spark plug, the rate of oxidation abrasion of the ground electrode-side discharge portion is higher than that of the center electrode-side discharge portion because the ground electrode-side discharge portion protrudes more largely into a combustion engine than the center electrode-side discharge portion so that the temperature of the ground electrode-side discharge portion is higher than that of the center electrode-side discharge portion. Therefore, in the invention, the Rh content of the ground electrode-side precious metal tip used in the ground electrode-side discharge portion is set to be larger than the Rh content of the center electrode-side discharge portion. Because the Rh content of the ground electrode-side precious metal tip is set to be larger than the Rh content of the center electrode-side precious metal tip, it is possible to suppress oxidation abrasion of Ir caused by the high temperature of the ground electrode-side discharge portion. On the other hand, because the Rh content of the center electrode-side precious metal tip lower in degree of oxidation abrasion than the ground electrode-side discharge portion is set to be smaller than the Rh content of the ground electrode-side precious metal tip, the amount of expensive Rh used in the whole of the spark plug can be reduced as sufficiently as possible.

Preferably, the ground electrode-side precious metal tip may contain 0.5 mass % to 8 mass % of Ni. As a result, it is possible to suppress abnormal abrasion of the ground electrode-side discharge portion containing Ir, and Rh. If the Ni content is smaller than 0.5 mass %, there is a possibility that the effect on suppressing abnormal abrasion cannot be obtained sufficiently. On the other hand, if the Ni content is larger than 8%, it is quite undesirable that resistance to spark abrasion of the ground electrode-side discharge portion is lowered because of the excessively large Ni content, and that resistance to oxidation abrasion of the ground electrode-side discharge portion is lowered because of increase in Ni oxide.

Preferably, the amount of at least one of Pt and Pd contained in the ground electrode-side precious metal tip may be in a range of from 1 mass % to 20 mass %. Thus, it is possible to effectively suppress peeling of precious metal in the surface of the discharge portion of the ground electrode-side discharge portion containing Ir as a main component, Rh, and Ni. If the total amount of Pt and Pd contained in the ground electrode-side precious metal tip is smaller than 1 mass %, there is fear that the effect on suppressing the peeling cannot be obtained sufficiently. On the other hand, if the total amount of Pt and Pd contained in the ground electrode-side precious metal tip is larger than 20 mass %, it is quite undesirable that resistance to spark abrasion of the ground electrode-side discharge portion is lowered because the melting point of the ground electrode-side precious metal tip is lowered. It is further preferable that the amount of at least one of Pt and Pd contained in the ground electrode-side precious metal tip is in a range of from 4 mass % to 8 mass %.

Preferably, the ground electrode-side precious metal tip may be characterized in that it contains 5.2 mass % to 41 mass % of Ru. As a result, it is possible to suppress occurrence of peeling of the ground electrode-side discharge portion and suppress abrasion and deformation of the ground electrode-side discharge portion. It is further preferable that the ground electrode-side precious metal tip contains 8 mass % to 20 mass % of Ru.

Figure 1:
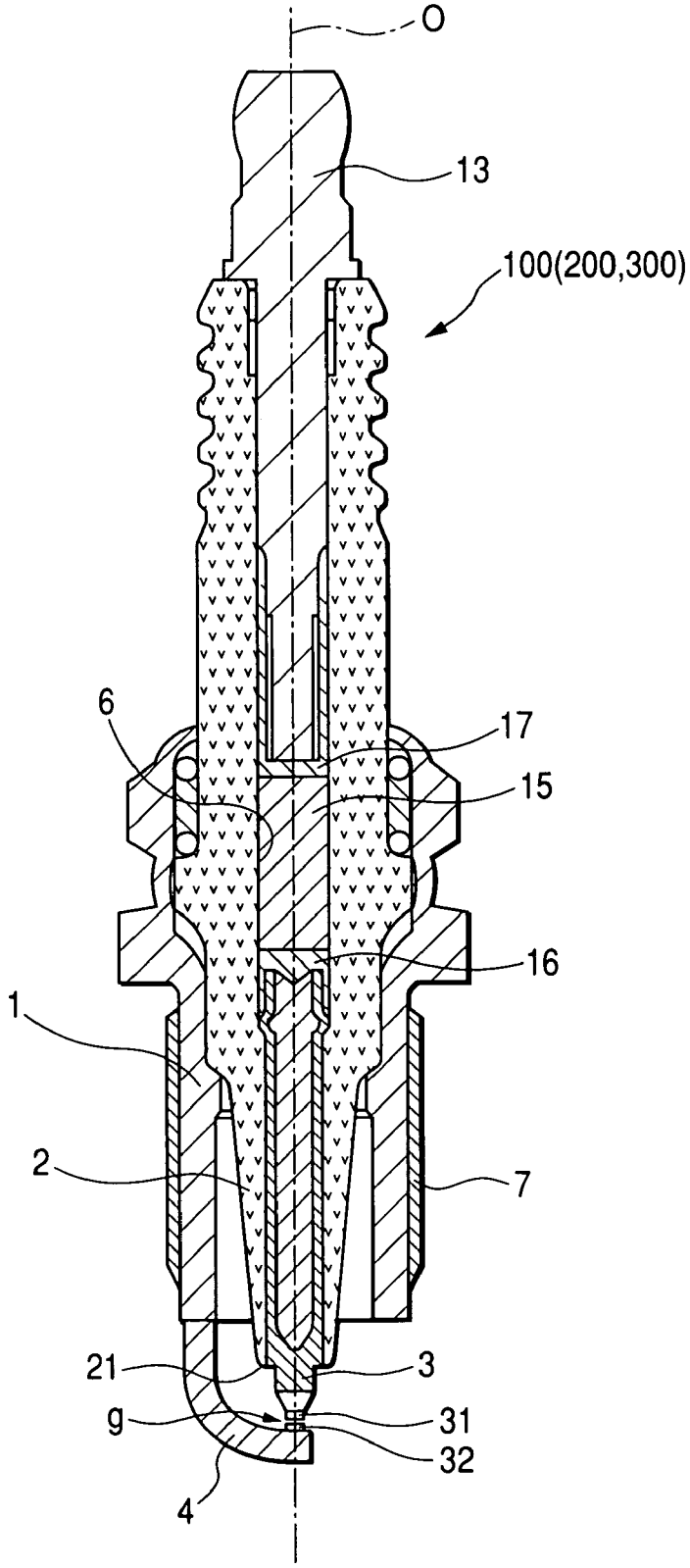
FIG. 1 is an overall front sectional view showing an embodiment of a spark plug according to the invention.

Incidentally, in the drawings, each of the reference numerals 100, 200 and 300 designates a spark plug; 1, a metal shell; 3, a center electrode; 4, a ground electrode; 31, a center electrode-side discharge portion; 32, a ground electrode-side discharge portion; 31', a center electrode-side precious metal tip; and 32', a ground electrode-side precious metal tip, and each of the reference symbols W and W' designates a welding portion.

BEST MODE FOR CARRYING OUT THE INVENTION

Embodiment 1

Figure 2A:
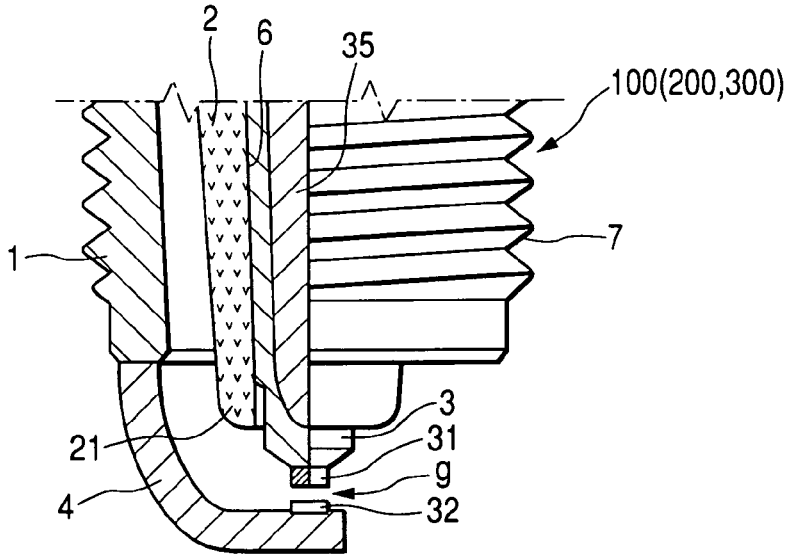
FIG. 2 is a partly sectional view of the spark plug depicted in FIG. 1 and an enlarged sectional view showing main part of the spark plug.
Figure 2B:
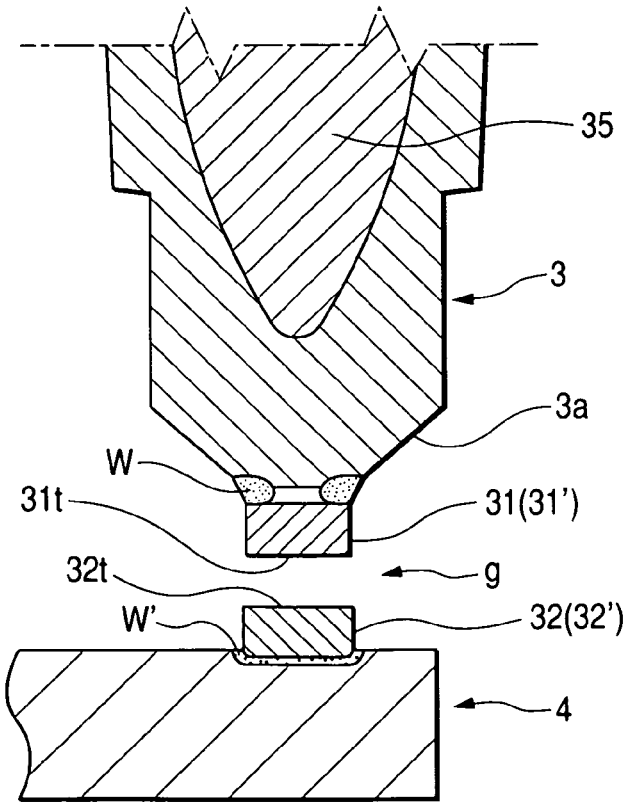
Figure 3:
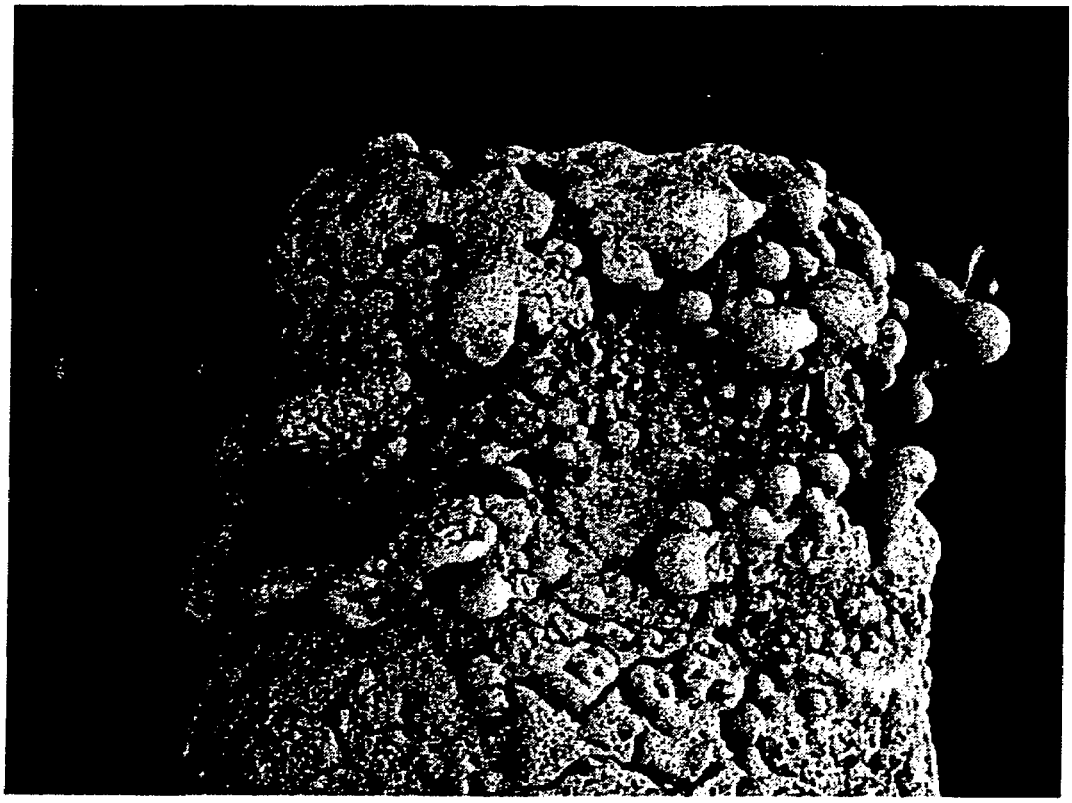
PRIOR ART FIG. 3
FIG. 3 is an observation photograph showing a state of a center electrode-side discharge portion due to peeling.

An embodiment of the invention will be described below on the basis of sectional view. FIG. 1 is a longitudinal sectional view showing an example of a spark plug 100 according to the invention. FIG. 2(*a*) is an enlarged view of a discharge portion of the spark plug 100 and its neighbor. The resistor-including spark plug 100 taken as an example of the invention includes a cylindrical metal shell 1, an insulator 2, a center electrode 3, a ground electrode 4, and so on. The insulator 2 is fitted into the metal shell 1 so that a leading end portion 21 of the insulator 2 protrudes out from the metal shell 1. The center electrode 3 is provided inside the insulator 2 in the condition that a center electrode-side discharge portion 31 formed at a leading end of the center electrode 3 is protruded out from the insulator 2. The ground electrode 4 has one end jointed to the metal shell 1 by means of welding or the like, and the other end bent toward one side so that the other end side surface of the ground electrode 4 is disposed opposite to the center electrode-side discharge portion 31 formed in the center electrode 3. A ground electrode-side discharge portion 32 is formed in the ground electrode 4 so as to be opposite to the center electrode-side discharge portion 31. A spark discharge gap g is formed in a space held between a center electrode-side discharge surface 31*t* of the center electrode-side discharge portion 31 and a ground electrode-side discharge surface 32*t* of the ground electrode-side discharge portion 32.

The insulator 2 is made of a ceramic sintered body such as alumina or aluminum nitride. The insulator 2 has a through-hole 6 formed therein so that the center electrode 3 can be fitted into the insulator 2 along the axial direction. The metal shell 1 is made of metal such as low-carbon steel and shaped like a cylinder. A threaded portion 7 for attaching the spark plug 100 to an engine block not shown is formed in the outer circumferential surface of the metal shell 1. A terminal 13 is fixedly inserted into one end portion of the through-hole 6. Likewise, the center electrode 3 is fixedly inserted into the other end portion of the through-hole 6. A resistor 15 is disposed in the through-hole 6 and between the terminal 13 and the center electrode 3. Opposite end sides of the resistor 15 are electrically connected to the center electrode 3 and the terminal 13 through sealing layers 16 and 17 of electrically conductive glass respectively. Incidentally, configuration may be made so that either of the center electrode-side discharge portion 31 and the ground electrode-side discharge portion 32 opposite thereto is omitted. In this case, the spark discharge gap g is formed between the center electrode-side discharge surface 31*t* of the center electrode-side discharge portion 31 or the ground electrode-side discharge surface 32*t* of the ground electrode-side discharge portion 32 opposite thereto and the ground electrode 4 or the center electrode 3.

For example, as shown in FIG. 2(*b*), the center electrode-side discharge portion 31 is formed in such a manner that a disc-like center electrode-side precious metal tip 31' is superposed on the end surface of a leading end portion 3*a* of the center electrode 3 and fixed by a welding portion W formed by means of laser welding or electron beam welding along an outer circumferential edge of the joint surface between the center electrode 3 and the center electrode-side precious metal tip 31'. The center electrode 3 is made of an Ni-based heat-resistant alloy such as INCONEL 600 or INCONEL 601 (registered trademark of Inco Europe Limited in the United Kingdom) or an Fe-based heat-resistant alloy. For example, in the case where a ground electrode-side discharge portion 32 is to be formed in the ground electrode 4 made of an Ni-based heat-resistant alloy such as INCONEL 600 or INCONEL 601, the ground electrode-side discharge portion 32 is formed in such a manner that a ground electrode-side precious metal tip 32' is aligned with the ground electrode 4 in accordance with a position opposite to the center electrode-side discharge portion 31 and fixed by a welding portion W' formed along the joint surface between the ground electrode 4 and the ground electrode-side precious metal tip 32', for example, by means of resistance welding.

Here, a center electrode-side precious metal tip 31' and a ground electrode-side precious metal tip 32' each made of an Ir-based alloy containing Ir as a main component, 0.5 to 40 mass % of Rh, 0.5 to 8 mass % of Ni, and 1.0 to 20 wt % of at least one of Pt and Pd are used in the center electrode-side discharge portion 31 and the ground electrode-side discharge portion 32 respectively. Thus, peeling of precious metal in the surface of the discharge portion of the center electrode-side discharge portion 31 and in the surface of the discharge portion of the ground electrode-side discharge portion 32 can be suppressed while spark abrasion, oxidation abrasion and abnormal abrasion of the center electrode-side precious metal discharge portion 31 and the ground electrode-side precious metal discharge portion 32 can be suppressed. Incidentally, each of the center electrode-side precious metal tip 31' and the ground electrode-side precious metal tip 32' may contain, as an additive element component, an oxide (including a composite oxide) of an element selected from Sr, Y, La, Ce, Pr, Nd, Sm, Eu, Gd, Tb, Dy, Ho, Er, Tm, Yb, Lu, Ti, Zr and Hf. Thus, oxidation abrasion can be suppressed more effectively.

The spark plug 100 has a structure in which the temperature of the center electrode-side discharge portion 31 is apt to be high. For example, as shown in FIG. 2, a core body 35 relatively excellent in heat conductivity compared with an electrode base material 36 forming a surface layer portion of the center electrode 3 is formed in the center portion of the center electrode 3. The core body 35 is formed for dissipating heat from the center electrode-side discharge portion 31 to the center electrode 3 side. The core body 35 is made of Cu, a Cu alloy or the like. In addition, in the spark plug 100, the core body 35 is formed only on the center electrode 3 side. Such a core body may be, however, formed on the ground electrode 4 side.

A method for producing the spark plug 100 will be described below. First, the center electrode-side precious metal tip 31' and the ground electrode-side precious metal tip 32' may be prepared in such a manner that powdered precious metals as raw materials are blended at a desired ratio and melted to form an alloy ingot. As a specific melting method, for example, a method of arc melting, plasma beam melting or the like may be used. Alternatively, the aforementioned ingot may be produced in such a manner that the blend of powdered precious metals at the desired ratio is compression-molded and sintered.

After the alloy is then processed into a wire-like or rod-like material by one kind or a combination of two or more kinds selected from hot forging, hot rolling and hot wire drawing, the wire-like or rod-like material is cut into pieces with a predetermined length in a longitudinal direction. For example, after the alloy is processed into a rod-like material by hot forging, the diameter of the rod-like material may be further reduced by hot rolling using a grooved pressure roll and hot swaging and the rod-like material is finally processed into a wire material having a wire diameter of not larger than 0.8 mm by hot wire drawing. Then, the wire material is cut to have a desired thickness. Thus, each of the center electrode-side precious metal tip 31' and the ground electrode-side precious metal tip 32' is obtained.

Alternatively, each of the center electrode-side precious metal tip 31' and the ground electrode-side precious metal tip 32' may be produced in such a manner that a globular precious metal alloy is produced by a known atomizing method so that the globular precious metal alloy may be used directly as a discharge portion or may be processed into a flat or cylindrical center electrode-side precious metal tip 31' or a flat or cylindrical ground electrode-side precious metal tip 32'. Or a blend of powdered precious metals as raw materials and a binder at a desired ratio may be molded into a molded body by means of powder compression molding such as mold-press molding, CIP molding, HIP molding, etc. The molded body may be degreased and then sintered. Thus, each of the center electrode-side precious metal tip 31' and the ground electrode-side precious metal tip 32' can be prepared.

The center electrode-side precious metal tip 31' is welded to the center electrode 3. The center electrode 3 to which the center electrode-side precious metal tip 31' has been welded is fitted into the through-hole 6 of the insulator 2 so that the center electrode-side precious metal tip 31' protrudes out from the insulator 2. An electrically conductive glass seal (which will serve as a glass sealing layer 17 after press-fitting) a resistance body (which will serve as a resistor 15 after press-fitting), an electrically conductive glass seal (which will serve as a glass sealing layer 17 after press-fitting) are inserted successively on the rear end side of the center electrode 3. A terminal 13 is inserted on the rear end side of the insulator 2. These members are press-fitted by a known method. The insulator 2 into which the center electrode 3, the terminal 13, etc. have been fitted is attached to the metal shell 1 to which the ground electrode 4 has been joined. Further, the ground electrode-side precious metal tip 32' is welded to the ground electrode 4 and then the ground electrode 4 is bent toward the center electrode 3 side to form a discharge gap g. Thus, the spark plug 100 can be obtained.

The aforementioned spark plug 100 according to the invention is used as an ignition source for igniting an air-fuel mixture supplied to a combustion chamber after the spark plug 100 is mounted in an engine block by the threaded portion 7. In use, a discharge voltage is applied between the center electrode-side discharge portion 31 and the ground electrode-side discharge portion 32 so that a spark is generated in the spark discharge gap g.

Embodiment 2

Embodiment 2 of the invention will be described below.

Incidentally, main differences of a spark plug 200 according to Embodiment 2 from the spark plug 100 according to Embodiment 1 are a center electrode-side precious metal tip 31' forming a center electrode discharge portion 31 and a ground electrode-side precious metal tip 32' forming a ground electrode-side discharge portion 32. Other parts of the spark plug 200 are almost the same as those of the spark plug 100. Accordingly, the parts different from those in Embodiment 1 will be mainly described while description about the parts the same as those in Embodiment 1 will be omitted or simplified.

For example, as shown in FIG. 2, the center electrode-side discharge portion 31 is formed in such a manner that a disc-like center electrode-side precious metal tip 31' is superposed on the end surface of a leading end portion 3*a* of a center electrode 3 and fixed by a welding portion W formed by means of laser welding or electron beam welding along an outer circumferential edge of the joint surface between the center electrode 3 and the center electrode-side precious metal tip 31'. The center electrode 3 is made of an Ni-based heat-resistant alloy such as INCONEL 600 or INCONEL 601 (registered trademark of Inco Europe Limited in the United Kingdom) or an Fe-based heat-resistant alloy. In the case where, for example, a ground electrode-side discharge portion 32 is to be formed in the ground electrode 4 made of an Ni-based heat-resistant alloy such as INCONEL 600 or INCONEL 601, the ground electrode-side discharge portion 32 is formed in such a manner that a ground electrode-side precious metal tip 32' is aligned with the ground electrode 4 in accordance with a position where opposite to the center electrode-side discharge portion 31 and fixed by a welding portion W' formed along the joint surface between the ground electrode 4 and the ground electrode-side precious metal tip 32', for example, by resistance welding.

The center electrode-side precious metal tip 31' is made of an Ir alloy containing Ir as a main component, Rh, and Ni and further containing at least one of Pt and Pd as represented by Ir-1 wt % Rh-5 wt % Pt-1 wt % Ni. Thus, peeling of precious metal in the surface of the discharge portion of the center electrode-side discharge portion 31 can be suppressed while spark abrasion, oxidation abrasion and abnormal abrasion of the center electrode-side discharge portion 31 can be suppressed.

On the other hand, the ground electrode-side precious metal tip 32' is also made of an Ir alloy containing Ir as a main component, Rh and Ni and further containing at least one of Pt and Pd as represented by Ir-10 wt % Rh-5 wt % Pt-1 wt % Ni. Thus, peeling of precious metal in the surface of the discharge portion of the ground electrode-side discharge portion 32 can be suppressed while spark abrasion, oxidation abrasion and abnormal abrasion of the ground electrode-side discharge portion 32 can be suppressed. In addition, the Rh content of the ground electrode-side precious metal tip 32' is set to be larger than that the Rh content of the center electrode-side precious metal tip 31'. Because Rh is added in this manner so that the Rh content of the ground electrode-side precious metal tip 32' is larger than the Rh content of the center electrode-side precious metal tip 31', it is possible to suppress oxidation abrasion of Ir of the ground electrode-side discharge portion 32 caused by increase in the temperature of the ground electrode-side discharge portion 32.

Embodiment 3

Embodiment 3 of the invention will be described below.

Incidentally, main differences of a spark plug 300 according to Embodiment 3 from the spark plug 100 according to Embodiment 1 and the spark plug 200 according to Embodiment 2 are a center electrode-side precious metal tip 31' forming a center electrode discharge portion 31 and a ground electrode-side precious metal tip 32' forming a ground electrode-side discharge portion 32. Other parts of the spark plug 300 are almost the same as those of the spark plug 100 or 200. Accordingly, the parts different from those in Embodiments 1 and 2 will be mainly described while description about the parts the same as those in Embodiments 1 and 2 will be omitted or simplified.

For example, as shown in FIG. 2, the center electrode-side discharge portion 31 is formed in such a manner that a disc-like center electrode-side precious metal tip 31' is superposed on the end surface of a leading end portion 3*a* of a center electrode 3 and fixed by a welding portion W formed by means of laser welding or electron beam welding along an outer circumferential edge of the joint surface between the center electrode 3 and the center electrode-side precious metal tip 31'. The center electrode 3 is made of an Ni-based heat-resistant alloy such as INCONEL 600 or INCONEL 601 (registered trademark of Inco Europe Limited in the United Kingdom) or an Fe-based heat-resistant alloy. In the case where, for example, a ground electrode-side discharge portion 32 is to be formed in the ground electrode 4 made of an Ni-based heat-resistant alloy such as INCONEL 600 or INCONEL 601, the ground electrode-side discharge portion 32 is formed in such a manner that a ground electrode-side precious metal tip 32' is aligned with the ground electrode 4 in accordance with a position opposite to the center electrode-side discharge portion 31 and fixed by a welding portion W' formed along the joint surface between the ground electrode 4 and the ground electrode-side precious metal tip 32', for example, by resistance welding.

The center electrode-side precious metal tip 31' is made of an Ir alloy containing Ir as a main component, Rh, and Ni and further containing at least one of Pt and Pd as represented by Ir-1 wt % Rh-5 wt % Pt-1 wt % Ni. Thus, peeling of precious metal in the surface of the discharge portion of the center electrode-side discharge portion 31 can be suppressed while spark abrasion, oxidation abrasion and abnormal abrasion of the center electrode-side discharge portion 31 can be suppressed.

On the other hand, the ground electrode-side precious metal tip 32' is also made of an Ir alloy containing Ir as a main component, Rh, and Ni and further containing Ru as represented by Ir-8 wt % Rh-11 wt % Ru-1 wt % Ni. Thus, occurrence of peeling of precious metal in the surface of the discharge portion of the ground electrode-side discharge portion 32 can be suppressed while spark abrasion, oxidation abrasion and abnormal abrasion of the ground electrode-side discharge portion 32 can be suppressed, so that abrasion and deformation of the ground electrode-side discharge portion 32 can be suppressed. In addition, the Rh content of the ground electrode-side precious metal tip 32' is set to be larger than the Rh content of the center electrode-side precious metal tip 31'. Because Rh is added in this manner so that the Rh content of the ground electrode-side precious metal tip 32' is larger than the Rh content of the center electrode-side precious metal tip 31', it is possible to suppress oxidation abrasion of Ir of the ground electrode-side discharge portion 32 caused by increase in the temperature of the ground electrode-side discharge portion 32.

EXAMPLES

Example 1

In order to examine the effect of the invention, the following tests were conducted.

First, precious metal tips for use in respective discharge portions of spark plugs were produced as follows. Initial element components were blended/mixed at various ratios to form various precious metal tips different in composition as shown in Table 1. Thus, various powdered raw materials were prepared. Then, each powdered raw material was pressure-molded into a rectangular parallelepiped with dimensions of 10 mm by 10 mm by 130 mm. The molded body was placed in an arc melting furnace and arc-melted. Thus, various alloy ingots different in composition were obtained. The alloys were subjected to hot forging, hot rolling and hot swaging at about 1500° C. and then subjected to hot wire drawing, thereby obtaining alloy wire materials each having an outer diameter of 0.6 mm. The alloy wire materials were cut in a longitudinal direction to thereby obtain cylindrical precious metal tips having various compositions and each having a diameter (tip diameter) of 0.6 mm and a thickness of 0.8 mm.

Incidentally, a precious metal tip for Sample 17 was not produced by the aforementioned producing method but produced by the following method. That is, powdered raw materials of Ir, Rh, Ni, Pt and $Y_2O_3$ were blended/mixed at a ratio shown in Table 1. For example, a binder of PVA was further mixed with the mixture powder to thereby prepare a mixture. Then, the mixture was pressure-molded into a cylindrical molded body having a diameter of 0.6 mm and a thickness of 0.8 mm. Further, the molded body was heated at 900° C.-1000° C. in a hydrogen atmosphere for 5 hours to thereby remove the binder from the molded body. After removal of the binder, the molded body was sintered at 2100° C. for an hour. Thus, the precious metal tip was obtained.

TABLE 1

| Sample No. | Composition (mass %) | Oxidation Abrasion | Spark Abrasion | Peeling | Judgment | |
|---|---|---|---|---|---|---|
| 1 | Ir—1Rh—1Ni | ○ | ○ | x | x | Comparative Example |
| 2 | Ir—1Rh—1Ni—0.5Pt | ○ | ○ | Δ | Δ | Examples |
| 3 | Ir—1Rh—1Ni—1PT | ○ | ○ | ○ | ○ | |
| 4 | Ir—1Rh—0.5Ni—10Pt | ○ | ○ | ○ | ○ | |
| 5 | Ir—1Rh—1Ni—5Pt | ○ | ○ | ○○ | ○ | |
| 6 | Ir—1Rh—1Ni—10Pt | ○ | ○ | ○ | ○ | |
| 7 | Ir—1Rh—1Ni—23Pt | ○ | Δ | ○ | Δ | |
| 8 | Ir—1Rh—0.5Ni—1Pd | ○ | ○ | ○ | ○ | |
| 9 | Ir—20Rh—1Ni—10Pt | ○ | ○ | ○ | ○ | |
| 10 | Ir—0.5Rh—1Ni—1Pd | ○ | ○ | ○ | ○ | |
| 11 | Ir—10Rh—1Ni—10Pd | ○ | ○ | ○ | ○ | |
| 12 | Ir—1Rh—1Ni—1Pd | ○ | ○ | ○ | ○ | |
| 13 | Ir—2.5Rh—1Ni—10Pt | ○ | ○ | ○ | ○ | |
| 14 | Ir—20Rh—1Ni—1Pt | ○ | ○ | ○ | ○ | |
| 15 | Ir—1Rh—1Ni—20Pt | ○ | ○ | ○ | ○ | |
| 16 | Ir—1Rh—1Ni—1Pt—1Pd | ○ | ○ | ○ | ○ | |
| 17 | Ir—1Rh—1Ni—1Pt—1$Y_2O_3$ | ○ | ○ | ○ | ○ | |
| 18 | Ir—10Rh—1Ni—5Pt | ○ | ○ | ○○ | ○ | |

An oxidation abrasion test was conducted under the following condition on the precious metal tips obtained in the aforementioned manner. That is, the weight of each precious metal tip which had been kept at a temperature of 1100° C. in the atmospheric air for 20 hours was compared with the weight of the precious metal tip before the test. The case where the weight of the precious metal tip after the test was not smaller than 90% of the weight of the precious metal tip before the test was evaluated as "o". The case where the weight of the precious metal tip after the test was smaller than 90% of the weight of the precious metal tip before the test was evaluated as "x". In any of the precious metal tips, the weight of the precious metal tip after the test was however not smaller than 90% of the weight of the precious metal tip before the test.

Further, in order to use each of the aforementioned precious metal tips as a center electrode-side precious metal tip 31', the precious metal tip was laser-welded to a center electrode base material 3*a* made of INCONEL 600. Thus, a spark plug 100 in the form shown in FIG. 1 or 2 was produced. In the test, a ground electrode-side discharge portion 32 of a ground electrode 4 made of INCONEL 600 had a tip diameter of 0.9 mm and a thickness of 0.6 mm and was constituted by a ground electrode-side precious metal tip 32' containing Pt, and 20 mass % of Ni. A durability test was conducted under the following condition on each of the spark plugs 100 obtained in aforementioned manner. That is, each spark plug 100 was mounted in a (six-cylinder) gasoline engine of 2000 cc displacement. The engine was operated up to 50 hours accumulatively in the full throttle condition at an engine rotational speed of 5600 rpm. The durability test was conducted on each spark plug 100 having a spark discharge gap g set at 1.1 mm.

Incidentally, the degree of abnormal abrasion in each of the spark plugs 100 after the durability test was evaluated by visual observation. As a result, in any of the spark plugs 100, abnormal abrasion of the center electrode-side discharge portion 31 was not found.

The degree of peeling in each of the spark plugs 100 after the durability test was evaluated by visual observation. The spark plug with no peeling was evaluated as "o" (in particular, the spark plug even without sweating was evaluated as "oo"). The spark plug undergoing the durability test throughout but with peeling was evaluated as "Δ". The spark plug failing to continue the durability test and with peeling was evaluated as "x". The evaluation results concerning peeling were shown in Table 1. As for evaluation results (evaluation results concerning resistance to spark abrasion) obtained based on measurement of the amount of increase in the gap in each of the spark plugs 100 after the operation up to the durability time, the spark plug in which the amount of increase in the spark discharge gap was smaller than 0.05 mm was evaluated as "o", the spark plug in which the amount of increase in the spark discharge gap was in a range of from 0.05 mm to 0.1 mm was evaluated as "Δ", and the spark plug in which the amount of increase in the spark discharge gap was larger than 0.1 mm was evaluated as "x". In Table 1, the evaluation result concerning peeling and the evaluation result concerning resistance to spark abrasion in each sample were tinged with each other to make an overall judgment. In the overall judgment, the spark plug having both evaluation results of "o" or better was evaluated as "o", the spark plug having one evaluation result of "o" and the other evaluation result of "Δ" was evaluated as "Δ", and the spark plug having both evaluation results not mentioned above was evaluated as "x". According to the overall judgment, it is proved that peeling can be suppressed when at least one of Pt and Pd is contained. It is also proved that resistance to spark abrasion can be obtained while peeling can be suppressed effectively when 1.0 mass % to 20 mass % of at least one of Pt and Pd is contained.

Although the invention has been described in detail with reference to specific embodiments, it is apparent to those skilled in the art that various changes and modifications can be made without departing from the sprit and scope of the invention.

This application is based on a Japanese patent application filed on Mar. 25, 2003 (Japanese Patent Application No. 2003-82491) and a Japanese patent application filed on May 28, 2003 (Japanese Patent Application No. 2003-151102), the contents of which are incorporated herein by reference.

INDUSTRIAL APPLICABILITY

Incidentally, the invention is not limited to the aforementioned specific embodiments. Various changes can be made within the scope of the invention in accordance with purposes and applications. In the spark plug 100 according to the invention, the welding portion W for welding the center electrode 3 is provided in the outer circumferential edge of the joint surface as shown in FIG. 2(*b*). The invention is not limited thereto. For example, the welding portion W may be formed continuously in the direction of the diameter of the center electrode-side precious metal tip 31'. In this manner, the center electrode-side precious metal tip 31' can be welded to the center electrode 3 more firmly.

The ground electrode-side precious metal tip 32' is resistance-welded to the ground electrode 4 to thereby form the welding portion W'. Alternatively, the welding portion W' may be formed by resistance welding and then by laser welding or electron beam welding along the outer circumferential edge of the joint surface so as to be joined firmly. Or the welding portion W' may be formed by laser welding. In this manner, the ground electrode-side precious metal tip 32' can be welded to the ground electrode 4 more firmly.

The invention claimed is:

1. A spark plug comprising:

a center electrode; and a ground electrode disposed so that a side surface of said ground electrode is opposite to a leading end portion of said center electrode, wherein:

a precious metal tip is welded to at least one of said center electrode and said ground electrode to thereby form a discharge portion having a discharge surface in a position opposite to a spark discharge gap; and said precious metal tip contains Ir as a main component, Rh, and Ni and further contains at least one of Pt and Pd, wherein an amount of at least one of Pt and Pd contained in said precious metal tip is not smaller than an amount of Ni contained in said precious metal tip and is in a range of 4 mass % to 8 mass %.

2. The spark plug as claimed in claim 1, wherein said precious metal tip contains 0.5 mass % to 8 mass % of Ni.

3. The spark plug as claimed in claim 1, wherein said precious metal tip contains 0.5 mass % to 40 mass % of Rh.

4. The spark plug as claimed in claim 1, wherein said precious metal tip contains an oxide (inclusive of a composite oxide) of an element selected from Sr, Y, La, Ce, Pr, Nd, Sm, Eu, Gd, Th, Dy, Ho, Er, Tm, Yb, Lu, Ti, Zr and Hf.

5. The spark plug as claimed in claim 1, wherein said precious metal tip contains at least one of $Y_2O_3$, $La_2O_3$ and $Zr_2O_3$.

6. A spark plug comprising:

a center electrode;

a center electrode-side discharge portion made of a center electrode-side precious metal tip welded to a leading end portion of said center electrode;

a ground electrode disposed opposite to said leading end portion of said center electrode; and a ground electrode-side discharge portion made of a ground electrode-side precious metal tip welded to said ground electrode, wherein:

a spark discharge gap is formed between said center electrode-side discharge portion and said ground electrode-side discharge portion;

said center electrode-side precious metal tip contains Ir as a main component, Rh, and Ni and further contains at least one of Pt and Pd so that an amount of at least one of Pt and Pd contained in said center electrode-side precious metal tip is not smaller than an amount of Ni contained in said center electrode-side precious metal tip and is in a range of 4 mass % to 8 mass %; and said ground electrode-side precious metal tip contains Ir as a main component, and Rh so that an amount of Rh contained in said ground electrode-side precious metal tip is larger than an amount of Rh contained in said center electrode-side precious metal tip.

7. The spark plug as claimed in claim 6, wherein said ground electrode-side precious metal tip contains 0.5 mass % to 8 mass % of Ni.

8. The spark plug as claimed in claim 6, wherein said ground electrode-side precious metal tip contains 1 mass % to 20 mass % of at least one of Pt and Pd.

9. The spark plug as claimed in claim 6, wherein said ground electrode-side precious metal tip contains 5.2 mass % to 41 mass % of Ru.

10. The spark plug as claimed in claim 6, wherein said center electrode-side precious metal tip contains 0.5 mass % to 8 mass % of Ni.

11. The spark plug as claimed in claim 6, wherein said center electrode-side precious metal tip contains 0.5 mass % to 40 mass % of Rh.

12. A spark plug comprising:

a center electrode;

a center electrode-side discharge portion made of a center electrode-side precious metal tip welded to a leading end portion of said center electrode;

a ground electrode disposed opposite to said leading end portion of said center electrode; and a ground electrode-side discharge portion made of a ground electrode-side precious metal tip welded to said ground electrode, wherein:

a spark discharge gap is formed between said center electrode-side discharge portion and said ground electrode-side discharge portion;

said center electrode-side precious metal tip contains Ir as a main component, 0.5 mass % to 40 mass % of Rh, and 0.5 mass % to 8 mass % of Ni and further contains 4 mass % to 8 mass % of at least one of Pt and Pd; and said ground electrode-side precious metal tip contains Ir as a main component, 0.5 mass % to 40 mass % of Rh, 0.5 mass % to 8 mass % of Ni, and 8 mass % to 20 mass % of Ru.

13. A spark plug comprising:

a center electrode;

a ground electrode disposed opposite to said center electrode, and a precious metal tip is welded to at least one of said center electrode and said ground electrode, said precious metal tip containing:

Ir as a main component;

0.5 mass % to 40 mass % of Rh;

4 mass % to 8 mass % of Pt; and 0.5 mass % to 8 mass % of Ni, wherein an amount of Pt contained in said precious metal tip is not smaller than an amount of Ni contained in said precious metal tip.

14. A spark plug comprising:

a center electrode;

a ground electrode disposed opposite to said center electrode, and a precious metal tip is welded to at least one of said center electrode and said ground electrode, said precious metal tip containing:

Ir as a main component;

0.5 mass % to 40 mass % of Rh;

4 mass % to 8 mass % of Pd; and 0.5 mass % to 8 mass % of Ni, wherein an amount of Pd contained in said precious metal tip is not smaller than an amount of Ni contained in said precious metal tip.

* * * * *

UNITED STATES PATENT AND TRADEMARK OFFICE

CERTIFICATE OF CORRECTION

PATENT NO. : 7,382,084 B2
APPLICATION NO. : 10/514786
DATED : June 3, 2008
INVENTOR(S) : Osamu Yoshimoto et al.

It is certified that error appears in the above-identified patent and that said Letters Patent is hereby corrected as shown below:

Title Page
Item (73), Assignee, should read:
--NGK Spark Plug Co., Ltd.--

Signed and Sealed this

Twenty-eighth Day of October, 2008

JON W. DUDAS
*Director of the United States Patent and Trademark Office*